US005273688A

United States Patent [19]

Dekok

[11] Patent Number: 5,273,688

[45] Date of Patent: Dec. 28, 1993

[54] CARBURETOR AIR VOLUME CONTROL

[75] Inventor: Abraham Dekok, Elida, Ohio

[73] Assignee: Gilbert J. Eastin, West Bloomfield, Mich.

[21] Appl. No.: 803,931

[22] Filed: Dec. 9, 1991 (Under 37 CFR 1.47)

[51] Int. Cl.[5] ..... F02M 19/03

[52] U.S. Cl. ..... 261/78.1; 261/DIG. 39

[58] Field of Search ..... 261/78.1, DIG. 39, 76, 261/DIGS. 61-64

[56] References Cited

U.S. PATENT DOCUMENTS

| | | | |
|---|---|---|---|
| 954,507 | 4/1910 | Fogler | 261/76 |
| 1,309,719 | 7/1919 | Curtis | 261/78 |
| 1,417,501 | 5/1922 | Collier | 261/DIG. 64 |
| 1,983,255 | 12/1934 | Wahlmark | 261/46 |
| 2,457,085 | 8/1943 | Kliever | 177/311 |
| 2,913,232 | 8/1956 | Silverman | 261/40 |
| 2,946,575 | 10/1958 | Rohr | 261/16 |
| 3,023,849 | 3/1962 | Tine | 184/55 |
| 3,664,648 | 5/1972 | Seeley, Jr. | 261/41 |
| 3,868,936 | 3/1975 | Rivere | 123/139 |
| 4,008,699 | 2/1977 | Braun et al. | 123/122 |
| 4,171,332 | 10/1979 | Gohnert | 261/DIG. 39 |
| 4,235,828 | 11/1980 | Howes | 261/78 |
| 4,329,964 | 5/1982 | Morris | 123/557 |
| 4,335,061 | 6/1982 | Kobayashi | 261/44 |
| 4,364,354 | 12/1982 | Kosuge et al. | 123/437 |
| 4,366,104 | 12/1982 | Miller | 261/18 |
| 4,387,063 | 6/1983 | Pontoppidan | 261/41 |
| 4,394,331 | 7/1983 | Okabe et al. | 261/18 |
| 4,411,233 | 10/1983 | Chenet et al. | 123/439 |
| 4,417,562 | 11/1983 | Dalke | 123/592 |
| 4,450,119 | 5/1984 | Kodo | 261/44 |
| 4,464,313 | 8/1984 | Martineau | 261/DIG. 39 |
| 4,473,510 | 9/1984 | Kato et al. | 261/39 |
| 4,483,805 | 11/1984 | Glindsjo | 261/DIG. 39 |
| 4,501,709 | 2/1985 | Yamamoto et al. | 261/44 |
| 4,512,312 | 4/1985 | Nakamura et al. | 123/439 |
| 4,517,134 | 5/1985 | Nakamura et al. | 261/39 |
| 4,559,185 | 12/1985 | Seto et al. | 261/41 |
| 4,629,590 | 12/1986 | Bagwell | 261/78.2 |
| 4,673,536 | 6/1987 | Morris | 261/78.1 |
| 4,767,576 | 8/1988 | Bagwell | 261/16 |
| 4,966,735 | 10/1990 | LoRusso | 261/40 |
| 5,053,170 | 10/1991 | Drahos | 261/DIG. 39 |

FOREIGN PATENT DOCUMENTS

| | | | |
|---|---|---|---|
| 2027969 | 12/1970 | Fed. Rep. of Germany | 261/76 |
| 875699 | 9/1942 | France | 261/DIG. 39 |
| 325518 | 3/1935 | Italy | 261/76 |
| 471140 | 9/1969 | Japan | 261/DIG. 56 |
| 84228 | 7/1954 | Norway | 261/76 |
| 334074 | 12/1958 | Switzerland | 261/78.1 |
| 467089 | 6/1937 | United Kingdom | 261/76 |

OTHER PUBLICATIONS

Kehoe, "The Quadrajet", General Motors Engineering Journal, vol. 13, No. 3, pp. 11-19, 1966.

*Primary Examiner*—Tim Miles
*Attorney, Agent, or Firm*—Krass & Young

[57] ABSTRACT

An apparatus for controlling the flow of air in a conventional venturi-type carburetor. A small tube and a large tube connected by a tapered transition tube is placed inside and concentric to the venturi of a carburetor with the large tube being closer to the throttle valve of the carburetor. The cross-sectional area of the large tube should be in the range of two to three times that of the small tube. A collar or draw plate is mounted around the small tube to control the air flow in the passageway formed by the outside of the wall of the small tube and the interior of the venturi. An aperture is provided in the peripheral surface of the small tube to permit the main fuel-metering nozzle of the carburetor to extend into the interior of the small tube. Small air bleed holes may be provided in the peripheral surface of the apparatus to permit the travel of gaseous materials between the exterior and the interior of the apparatus. The apparatus may be constructed in a single piece for original equipment applications or may be constructed in several pieces to permit ease of installation for add-on applications.

20 Claims, 2 Drawing Sheets

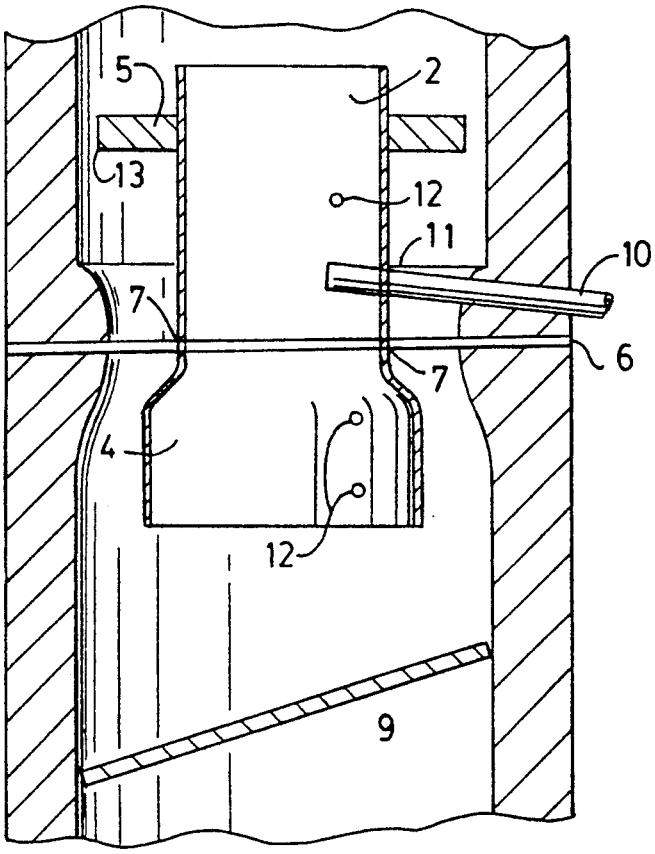
FIG-1
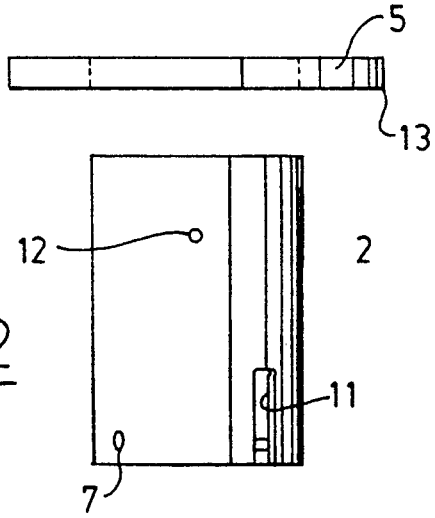
FIG-2
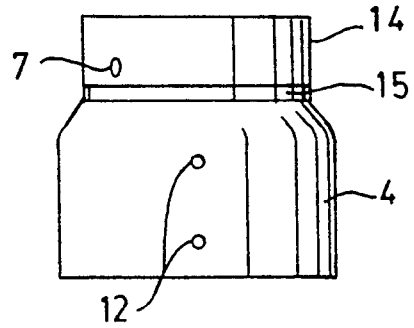

CARBURETOR AIR VOLUME CONTROL

FIELD OF THE INVENTION

This invention pertains to the field of carburetion of internal combustion engines, specifically to devices which control or modify the flow of combustion air to the intake manifold of the engine.

DESCRIPTION OF THE PRIOR ART

The internal combustion engine transforms the chemical energy in an approximately stoichiometric mixture of fuel, such as gasoline and air, into mechanical energy. The function of the carburetor is to provide the proper mixture of air and fuel to the intake manifold of the engine.

In the typical modern carburetor, incoming air is introduced into one or more main venturi, or constricted, passageways. At the throat of each venturi the reduced cross-sectional area for flow causes the air to move faster. The increase in kinetic energy of the air is balanced by a decrease in pressure at the venturi throat. This reduction of pressure, which is related in a non-linear fashion to the air flow rate, induces a flow of liquid fuel through a main fuel-metering nozzle which terminates in the venturi throat. The liquid fuel vaporizes and is sufficiently mixed with combustion air before finally entering the combustion zone.

Over the years, numerous refinements have been made to the basic venturi-type carburetor in order to enable it to properly proportion fuel to speed and load. These include idle systems, which add liquid fuel at low air flow rates, and power enrichment systems, which supplement the main fuel-metering nozzle at high air flow rates.

One refinement, pertinent here, is the use of an auxiliary venturi, sometimes called a boost venturi, located inside the throat of the main venturi and concentric to it. Indeed, more than one boost venturi can be used, the second boost venturi inside and concentric to the first boost venturi. These boost venturis are used in an attempt to mix the proper amount of liquid fuel and air over a wide range of engine operating conditions. Examples of some prior art boost venturis and venturi systems include U.S. Pat. No. 4,171,332 to Gohnert; U.S. Pat. No. 4,417,562 to Dalke; U.S. Pat. No. 4,450,119 to Kodo; and German Patent Specification DE 2027969.

While the above described modifications, along with others not mentioned, are capable, for the most part, of yielding satisfactory performance, prior art boost venturis suffer from two major disadvantages. First, the devices are often mechanically complex and are therefore difficult to adjust. Second, major field adjustments of air to fuel ratio are difficult, if not impossible. The second disadvantage is particularly distressing to the field mechanic seeking to minimize fuel usage for a particular set of driving conditions. Also, the devices are relatively expensive to manufacture due to their complex mechanical nature and the manner in which they are mounted in the carburetor.

SUMMARY OF THE INVENTION

The invention deals with the field of carburetion for an internal combustion engine, specifically with an air volume control device in the form of a boost venturi for controlling the volumetric flow rate of air through the carburetor.

The preferred embodiment employs a small tube, one end of which tapers outwardly in a bell-shaped section to a larger tube. The device is mounted inside and concentric to the main venturi of a conventional venturi-type carburetor with the larger tube being closest to the throttle valve of the carburetor. An aperture in the small tube of the device permits the main fuel-metering nozzle of the carburetor to terminate inside the device.

A removable draw plate, or collar, is attached in an annular fashion to the exterior of the small tube near the upstream end of the air volume control device. The removable draw plate attaches to the air volume control with a snap- or friction-fit. The draw plate can be easily and inexpensively changed once the air volume control has been installed to adapt it to different operating conditions for maximum fuel efficiency.

The air volume flow control device of the present invention can be inexpensively manufactured, and is easily installed by the engine manufacturer or as an after-market addition by the vehicle operator. It can be formed either as an integral unit or as a two- or three-piece assembly.

The air volume control device can be used in carburetors without existing boost venturi, or with existing boost venturi in a complementary manner by mounting it around or within the existing boost venturi.

BRIEF DESCRIPTION OF THE DRAWINGS

FIG. 1 is a side view showing a portion of a conventional venturi-type carburetor with the air volume control device in place in the main venturi; and FIG. 2 is an exploded view of a three-piece air volume control device.

DESCRIPTION OF THE PREFERRED EMBODIMENT

Figure 3:
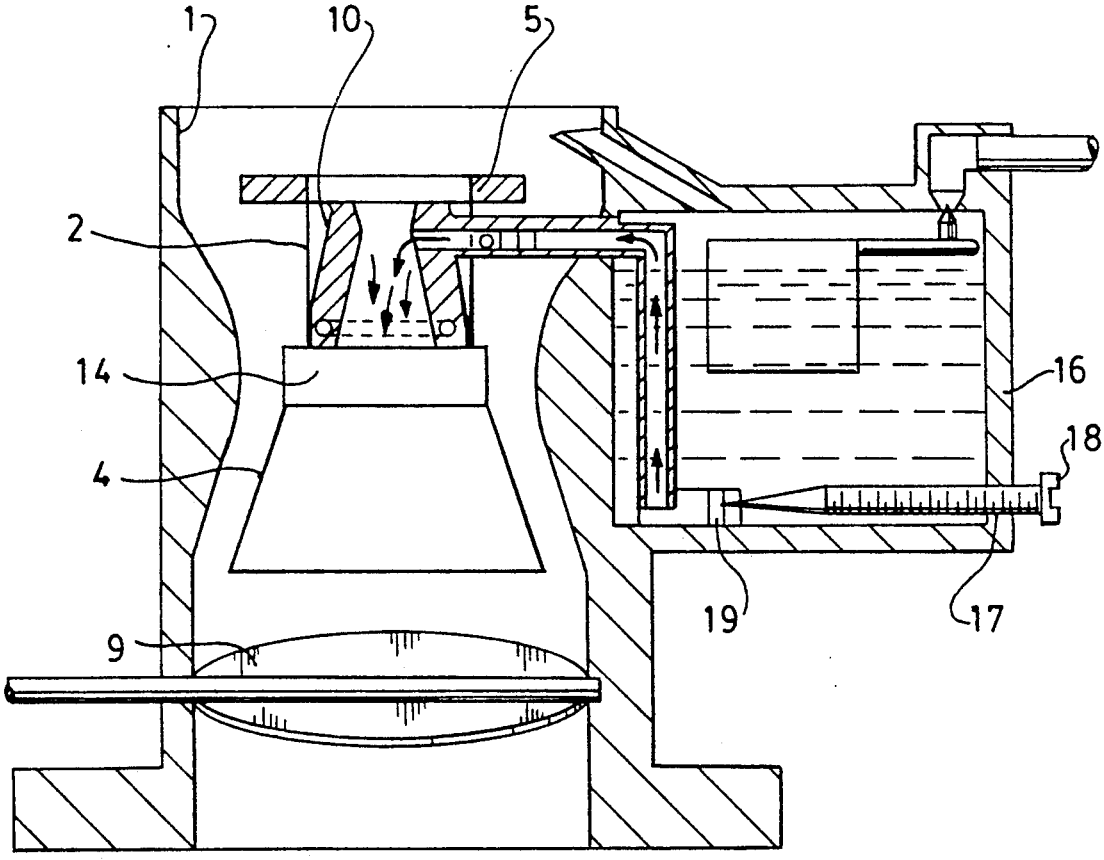
FIG. 3 shows the air volume control invention of FIG. 2 mounted in complementary fashion with an existing fixed boost venturi in the carburetor main venturi.

The main venturi air volume control device improves the control and adjustment of air flow through a conventional venturi-type carburetor. The device is inserted into the main venturi 1 of a conventional venturi-type carburetor such that the device and the venturi are concentric. By main venturi 1, what is intended is the passageway which includes the constriction or venturi section. The device itself has a small tube section 2, a bell taper section 3, and a large tube section 4. A collar or draw plate 5 is attached to the small tube section in an annular fashion. Means, such as a pin 6, which extends from the main venturi 1 walls through holes 7, are provided to align the device inside the venturi and to support it a distance above the throttle valve 9 sufficient to prevent interference with the throttle valve 9. Although only one pin 6 is shown for clarity, more than one would be preferably used to hold the device in place.

The main fuel-metering nozzle 10 is snug fit through an aperture 11 in the device to permit the liquid fuel to be brought inside the device. Appropriate connections, not shown, may supply fresh air to the inside of the main venturi volume control device and recycle air, such as that from positive crankcase ventilation systems, exhaust gas recirculation systems, fuel vapor recovery systems, and the like, to the annular region between the outside of the device and the inside walls of the main venturi 1. Alternatively, fresh air may be provided in the annular region and recycle air to the inside of the device. As a further option, fresh air and recycled air may be supplied to the annular region and to the inside of the device in any proportions desired, including the case in which the recycle air and the fresh air are completely mixed.

Small bleed holes 12 may be provided in various positions along the device to permit the travel of gaseous materials between the exterior and interior of the device, thereby modifying the local air-fuel ratio.

The function of the draw plate 5 is to reduce the available cross-sectional area for flow exterior to the small tube section 2 thereby urging a greater proportion of the incoming air to travel inside the small tube section 2 and modifying the total amount of incoming air through the main venturi 1. By varying the size of the draw plate 5, the designer can adjust, in a very precise manner, the volumetric air flow rate to a desired level. For this purpose, draw plate 5 is preferably removably mounted about the upper portion of small tube section 2.

The draw plate 5 has been shown in the figures as having both major surfaces flat, much in the nature of an ordinary washer. It has been found, however, that although flat surfaces will give satisfactory performance, superior performance of the device is observed when the bottom corner 13 of the draw plate is modified from the sharp edge shown in the figures to a rounded surface.

The thickness of the draw plate 5 should be substantially less than its radial extent, much resembling an ordinary washer.

The cross-sectional area of the large tube section 4 must be larger than that of the small tube section 2, the preferred ratio being in the range of two or three to one. A general sizing formula for the air volume control device is:

AVC SIZE FORMULA

Inlet diamter of tube section (2)=50–80% smaller than inlet diameter of main venturi Diameter of draw plate (5)=15–20% smaller than inlet diameter of main venturi Diameter of large/small tube junction or connector tube (14)=25% smaller than swedge or waist diameter of main venturi Outlet diameter of large tube section (4)=15–20% smaller than outlet diameter of main venturi The best basic developmental or starting formula is:

(2)=50%
(5)=15%
(14)=25%
(3)=15%

Test results indicate that the air volume control device of the present invention, properly installed and provided with the proper size draw plate, substantially decreases both fuel consumption and emission of carbon monoxide and unburned hydrocarbons.

Tests with a 1962 Karmen Ghia automobile having a single-barrel carburetor indicated a baseline efficiency of 24 miles per gallon (mpg) without the air volume control device of the present invention. Efficiency with a properly adjusted air volume control device was increased to a range of 44–56 mpg.

Tests with a 1973 Pontiac automobile having a two-barrel carburetor and baseline fuel efficiency of 9–15 mpg resulted in efficiency increases to as high as 25 mpg using a properly adjusted air volume control device according to the invention.

The Karmen Ghia was further tested using On Board Fluidyne Monitoring Equipment and one passenger. Average fuel efficiency without the air volume control device was 27.98 mpg, while emission test results were as follows: CO— 87.0 gm/mile; HC—8.8 gm/mile; NOX—3.6 gm/mile. Average fuel efficiency with the air volume control device was increased to 39.77 mpg, while emissions were reduced to the following levels: CO—5.251 gm/mile; HC—1.036 gm/mile; NOX—2.441 gm/mile.

Some minor modifications to the carburetor may be needed in order to properly adjust the air volume control device for optimum efficiency. If the carburetor in which the device is to be installed does not have controllable main fuel jets, a hole should be drilled in the carburetor bowl and threaded. A needle valve can then be inserted to monitor and control the amount of fuel entering the fuel nozzle. On some carburetor models the air mixer tubes and other jets may have to be made smaller. These and other modifications should be apparent to and well within the capabilities of those skilled in the art of combustion engines.

For example, the following steps are taken in properly adjusting and tuning an air volume control according to the present invention installed in a 30-PictSolex one barrel carburetor: disconnect and block both ends of the vacuum advance line from the carburetor to the diaphragm; screw all jets to a full stop or closed position (main jet, idle, air bypass); turn choke adjustment until it is wide open at cool room temperature; open the main jet a few turns; open the idle jet until the engine starts and runs smoothly; slowly close the main jet until the engine starts to flutter, then back the main jet open a turn or more; set the idle at approximately 1800 rpm and let the engine warm up a few minutes; advance and set the timing until optimum efficiency is reached, leaving the air bypass closed. The above tuning operations can be altered depending on the type of carburetor and automobile engine, as will be apparent to those skilled in the art.

Although the main venturi air control device may be fashioned in one piece and may be designed as an original part of the carburetor, for do-it-yourself or add-on markets a three-piece device as shown in FIG. 2 is preferable.

The small tube section 2 may be inserted into a short connector tube 14 having an inside diameter slightly larger than the outside diameter of the short tube section, thereby assuring a snug fit. A suitable stop 15 for the small tube section 2 may be fashioned, for example, by rolling in the connector tube 14 at the desired position.

The draw plate 5 in all the embodiments of FIGS. 1–3 is preferably removable and can be slipped over the small tube section 2 with a stop being provided by any suitable means such as, for example, simple friction or a complementary annular bead and groove formed on the small tube section 2 and the draw plate 5.

Referring now to FIG. 3, a three-piece air volume control device is shown mounted over an existing boost venturi 10 within the main venturi 1. The three-piece assembly lends itself particularly well to mounting over, or even within, an existing boost venturi. FIG. 3 also shows the above-mentioned modification to carburetor bowl 16 including a threaded hole 17 through which a needle valve 18 is threaded to adjust the amount of fuel flowing through main fuel jet 19.

If the carburetor main venturi 1 has a choke plate (not shown), draw plate 5 should be mounted essentially flush with the air inlet aperture of small tube section 2 as shown in FIG. 3. If there is no choke plate, small tube section 2 should extend above draw plate 5 to a point essentially flush with the top of the main venturi when the air volume control has been installed.

The air flow control device of the present invention is preferably made of a lightweight, fuel-resistant metal such as copper, although other suitable metals or heat and fuel-resistant plastics can be used.

Although the present invention has been described in part in reference to specific examples, modifications and variations may be constructed or used without departing from the scope of the invention, which is precisely described in the following claims.

I claim:

1. In an internal combustion engine having a carburetor with a main venturi having an inlet, an outlet, and a throttle plate disposed near the main venturi outlet, an air volume control device for mounting in the main venturi upstream of the throttle plate comprising:

a hollow body having an upper tubular portion with an air flow inlet aperture, and a lower bell-shaped portion having an air flow outlet aperture of greater diameter than said inlet;

means for mounting the hollow body within the main venturi essentially concentric therewith and spaced from the walls of the main venturi; and removable draw plate means mounted on the upper portion of the hollow body near the air flow inlet aperture to restrict air flow through the main venturi exterior of the air volume control device.

2. Apparatus as defined in claim 1, wherein the hollow body has formed therein a number of bleed apertures to facilitate fluid flow between the interior of the hollow body and the main venturi.

3. Apparatus as defined in claim 1, wherein the removable draw plate means comprise an annular collar mounted about the upper portion of the air flow control device.

4. Apparatus as defined in claim 3, wherein the diameter of the draw plate means is less than the diameter of the inlet of the main venturi.

5. Apparatus as defined in claim 3, wherein said draw plate means is mounted essentially flush with the air flow inlet aperture on the upper tubular portion.

6. Apparatus as defined in claim 3, wherein the removable draw plate means is mounted on the upper portion of the air flow control device in a snap-fit.

7. Apparatus as defined in claim 6, wherein the annular collar comprises a circular washer having an inner diameter approximately equal to the outer diameter of said upper tubular portion.

8. Apparatus as defined in claim 6, wherein the annular collar has a rounded lower edge portion on the downstream side of the collar.

9. Apparatus as defined in claim 6, wherein the mounting means comprises a pin member extending through corresponding mounting apertures formed in the hollow body, the ends of the pin member secured to the walls of the main venturi.

10. In an internal combustion engine having a carburetor comprising a main venturi having an inlet and an outlet, a throttle plate mounted in the main venturi near the outlet, an air volume control device for mounting in the main venturi upstream of the throttle plate comprising:

a hollow body having an upper tubular portion with an air flow inlet aperture, and a lower bell-shaped portion having an air flow outlet aperture of greater diameter than said inlet aperture;

means for removably mounting the hollow body within the main venturi of the carburetor essentially concentric therewith and spaced from the walls of the main venturi; and removable draw plate means mounted on the upper portion of the hollow body near the air flow inlet aperture to restrict air flow through the main venturi exterior of the hollow body, the removable draw plate means comprising an annular collar having an inner diameter such that it can be slidably mounted to the exterior of the upper tubular portion of the hollow body in a friction-fit, and an outer diameter less than the diameter of the main venturi inlet, the annular collar further including a rounded lower edge portion on a downstream side of the collar.

11. Apparatus for controlling the flow of air in a conventional venturi-type carburetor for an internal combustion engine, said carburetor comprising at least one main venturi, a throttle plate, and a main fuel-metering nozzle, comprising:

a first tube positioned inside and concentric to the main venturi of said carburetor, said first tube having an upper end and a lower end;

a second tube positioned inside and concentric to the main venturi of said carburetor and closer to the throttle plate of the carburetor than said first tube, said second tube having an interior cross-sectional area for flow in the range of two to three times that of said first tube;

a tapered transition tube connected to the second tube to axially receive and connect said first tube to said second tube;

a fuel inlet aperture in the peripheral surface of said first tube, positioned intermediate the first tube upper and lower ends to permit the main fuel-metering nozzle of the carburetor to penetrate to the interior of said first tube, the fuel inlet aperture extending axially to the lower end of the first tube; and means for firmly positioning said first tube, said second tube, and said tapered transition tube in a concentric position to the main venturi of the carburetor.

12. Apparatus as defined in claim 11, further comprising a collar annularly positioned around said first tube.

13. Apparatus as defined in claim 11 wherein the fuel inlet aperture comprises an axial slot having an upper end terminating between the first tube upper and lower ends, and a second end open at the first tube lower end, the axial slot having a width sufficient to permit the fuel inlet aperture to slidingly engage the fuel-metering nozzle.

14. Apparatus as defined in claim 13, wherein in an assembled condition the main fuel-metering nozzle penetrates the interior of the first tube via said fuel inlet aperture, the upper end of the fuel inlet aperture abutting the fuel-metering nozzle, and the tapered transition tube overlying the fuel inlet aperture slot below the fuel-metering nozzle and abutting the fuel-metering nozzle.

15. Apparatus as defined in claim 11, further comprising one or more apertures, in addition to said fuel-inlet aperture, in the peripheral surface of one or more of said first tube, second tube, and tapered transition tube.

16. Apparatus as defined in claim 15, further comprising a collar annularly positioned around said first tube, said collar having a thickness substantially smaller than its extent in its radial direction.

17. Apparatus as defined in claim 15, further comprising a collar annularly positioned around said first tube, said collar having a horizontal lower surface and a substantially vertical outermost surface connected to said lower surface such that the intersection between the lower surface and the outermost surface is rounded with a radius of curvature of at least one-eighth of the thickness of the collar, said collar having a thickness substantially smaller than its extent in its radial direction.

18. Apparatus for controlling the flow of air in a conventional venturi-type carburetor for an internal combustion engine, said carburetor comprising at least one main venturi, a throttle plate, and a main fuel-metering nozzle, comprising:

a first tube positioned inside and concentric to the main venturi of said carburetor, said first tube having an upper end and a lower end;

a second tube positioned inside and concentric to the main venturi of said carburetor and closer to the throttle plate of the carburetor than said first tube, said second tube having an interior cross-sectional area for flow in the range of two to three times that of said first tube;

a tapered transition tube connected to the second tube to axially receive and connect said first tube to said second tube;

a fuel inlet aperture in the peripheral surface of said first tube, positioned to permit the main fuel-metering nozzle of the carburetor to penetrate to the interior of said first tube;

means for firmly positioning said first tube, said second tube, and said tapered transition tube in a concentric position to the main venturi of the carburetor; and, a collar annularly positioned around said first tube.

19. Apparatus as defined in claim 18, wherein said collar has a thickness substantially smaller than its extent in its radial direction.

20. Apparatus as defined in claim 18, wherein said collar has a horizontal lower surface and a substantially vertical outermost surface connected to said lower surface such that the intersection between the lower surface and the outermost surface is rounded with a radius of curvature of at least one-eighth of the thickness of the collar, said collar having a thickness substantially smaller than its extent in its radial direction.

* * * * *